US009208725B2

(12) United States Patent
Guo et al.

(10) Patent No.: US 9,208,725 B2
(45) Date of Patent: Dec. 8, 2015

(54) DISPLAYS WITH PIXEL CIRCUITS CAPABLE OF COMPENSATING FOR TRANSISTOR THRESHOLD VOLTAGE DRIFT

(71) Applicant: InnoLux Corporation, Chu-Nan, Miao-Li County (TW)

(72) Inventors: Hong-Ru Guo, Chu-Nan (TW); Gong-Chen Guo, Chu-Nan (TW); Ming-Chun Tseng, Chu-Nan (TW)

(73) Assignee: INNOLUX CORPORATION, Miao-Li County (TW)

( * ) Notice: Subject to any disclaimer, the term of this patent is extended or adjusted under 35 U.S.C. 154(b) by 187 days.

(21) Appl. No.: 13/913,668

(22) Filed: Jun. 10, 2013

(65) Prior Publication Data

US 2013/0335307 A1 Dec. 19, 2013

(30) Foreign Application Priority Data

Jun. 13, 2012 (TW) ..... 101121069 A

(51) Int. Cl.
*G09G 3/30* (2006.01)
*G09G 3/32* (2006.01)

(52) U.S. Cl.
CPC ..... *G09G 3/3258* (2013.01); *G09G 3/3233* (2013.01); *G09G 2300/0852* (2013.01); *G09G 2300/0861* (2013.01)

(58) Field of Classification Search
None
See application file for complete search history.

(56) References Cited

U.S. PATENT DOCUMENTS

| | | | | |
|---|---|---|---|---|
| 7,812,796 | B2 | 10/2010 | Jung | |
| 2001/0024186 | A1 * | 9/2001 | Kane et al. | 345/98 |
| 2007/0273620 | A1 * | 11/2007 | Yumoto | 345/76 |
| 2009/0315877 | A1 * | 12/2009 | Deane | 345/214 |
| 2010/0156762 | A1 | 6/2010 | Choi | |
| 2010/0225623 | A1 * | 9/2010 | Ohhashi et al. | 345/205 |
| 2010/0309187 | A1 | 12/2010 | Kang et al. | |

OTHER PUBLICATIONS

Chinese language office action dated Feb. 4, 20154, issued in Application No. 201210192878.0.
TW Office Action dated Apr. 21, 2014.

* cited by examiner

*Primary Examiner* — Adam R Giesy
*Assistant Examiner* — Henok Heyi
(74) *Attorney, Agent, or Firm* — McClure, Qualey & Rodack, LLP

(57) ABSTRACT

A display device includes a pixel array. The pixel array includes multiple pixel elements. At least one pixel element includes an OLED, a first transistor, a second transistor, a third transistor, a first capacitor and a second capacitor. The first transistor has a first terminal coupled to an anode of the OLED for driving the OLED. The second transistor is coupled between a second terminal of the first transistor and a reset voltage and has a control terminal receiving a reset signal. The third transistor is coupled between the anode of the OLED and a control terminal of the first transistor and has a control terminal receiving a compensation signal. The first capacitor is coupled between the control terminal of the first transistor and the anode of the OLED. The second capacitor is coupled to the first capacitor and the control terminal of the first transistor.

8 Claims, 7 Drawing Sheets

DISPLAYS WITH PIXEL CIRCUITS CAPABLE OF COMPENSATING FOR TRANSISTOR THRESHOLD VOLTAGE DRIFT

CROSS REFERENCE TO RELATED APPLICATIONS

This Application claims priority of Taiwan Patent Application No. 101121069, filed on Jun. 13, 2012, the entirety of which is incorporated by reference herein.

BACKGROUND OF THE INVENTION

1. Field of the Invention

The invention relates to a pixel circuit, and more particularly, to a pixel circuit capable of compensating for transistor threshold voltage drift.

2. Description of the Related Art

Due to the use of Thin Film Transistor-Active Matrix Organic Light Emitting Diodes (TFT-AMOLEDs), the current display device has a low manufacturing cost, high response speed (more than a hundred times that of traditional LCD displays), low power consumption, a huge operating temperature range, as well as a light weight, etc., and therefore, use of TFT-AMOLEDs has become mainstream.

There are two ways of manufacturing the TFT-AMOLED, one is by using the Low Temperature Poly-silicon (LTPS) TFT technology and another one is by using the Amorphous Silicon (a-Si) TFT technology. When driving the TFT, the LTPS technology usually adopts P type transistors as the driving TFT, and the a-Si usually adopts N type transistors as the driving TFT. The a-Si technology results in a comparably better thin-film transistor uniformity, as well as lower production costs. However, the disadvantage of using the N type driving TFT is that the threshold voltage of transistors may drift after being used for a period of time. Therefore, even after applying the same driving voltage, after being used for a period of time, the driving TFT is unable to output the same driving current as initially, causing some lines to undesirably become darker or brighter than it should be. This is called the MURA effect. Another disadvantage, is that the N type driving TFT is used with an inverted OLDE, and the fabrication of the inverted OLDE is more complex as compared to a normal OLED.

Therefore, a novel pixel circuit using the N type driving TFT with the normal OLED, capable of compensating for the threshold voltage drift, is highly required.

BRIEF SUMMARY OF THE INVENTION

Display devices with pixel circuits capable of compensating for transistor threshold voltage drift are provided. An exemplary embodiment of a display device comprises a pixel array. The pixel array comprises a plurality of pixel elements. At least one pixel element comprises an OLED, a first transistor, a second transistor, a third transistor, a first capacitor and a second capacitor. The first transistor comprises a first terminal coupled to an anode of the OLED for driving the OLED. The second transistor is coupled between a second terminal of the first transistor and a reset voltage and comprises a control terminal receiving a reset signal. The third transistor is coupled between the anode of the OLED and a control terminal of the first transistor and comprises a control terminal receiving a compensation signal. The first capacitor is coupled between the control terminal of the first transistor and the anode of the OLED. The second capacitor is coupled to the first capacitor and the control terminal of the first transistor.

A detailed description is given in the following embodiments with reference to the accompanying drawings.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
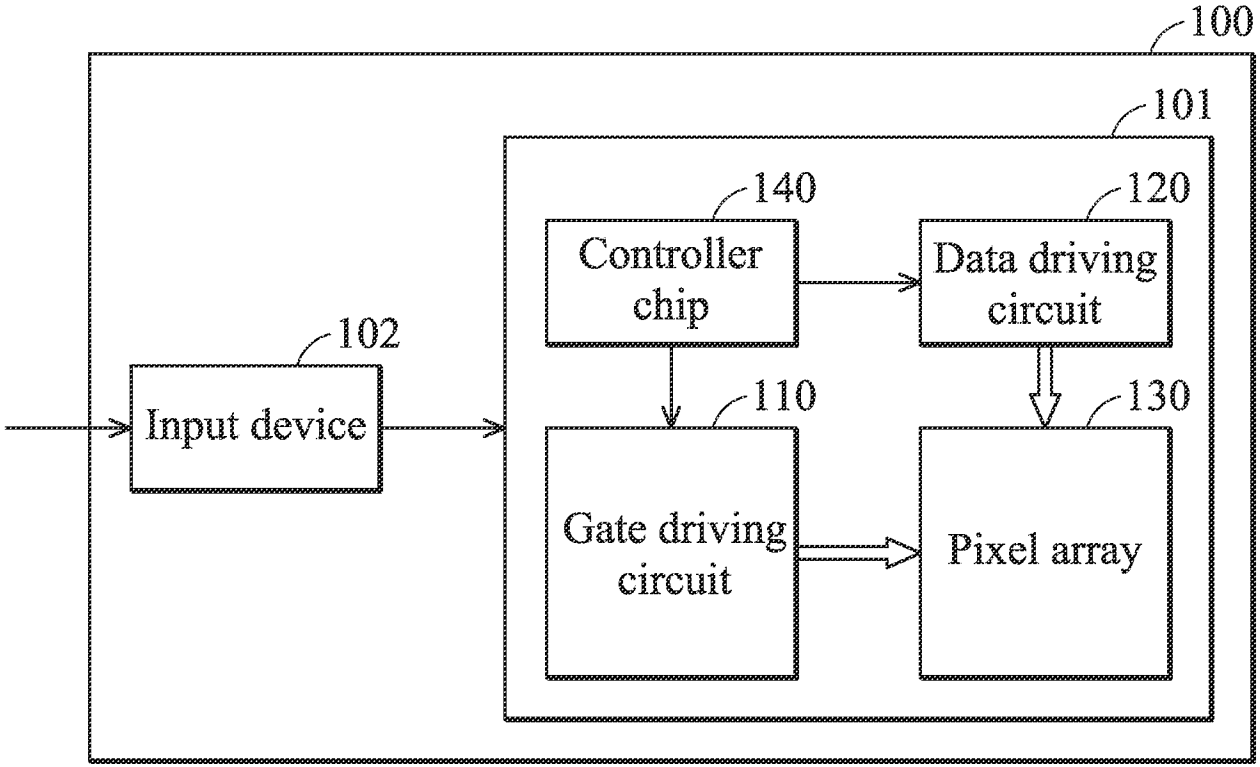
FIG. 1 shows one of the various types of displays of the invention according to an embodiment of the invention.

FIG. 1 shows one of the various types of displays of the invention according to an embodiment of the invention. As shown in FIG. 1, the display may comprise a display panel 101, where the display panel 101 may comprise a gate driving circuit 110, a data driving circuit 120, a pixel array 130 and a controller chip 140. The gate driving circuit 110 outputs a plurality of gate driving signals to drive a plurality of pixel elements on the pixel array 130. The data driving circuit 120 outputs a plurality of data driving signals to provide data to the pixel elements of the pixel array 130. The controller chip 140 may comprise a timing controller for receiving an image signal from a host (not shown), generating the plurality of gate driving signals and data driving signals according to the image signal, and generating a plurality of timing signals, comprising a plurality of control signals (which will be further discussed in the following paragraphs), for controlling operations of the display panel 101.

In addition, the display of the invention may further be comprised in an electronic device 100. The electronic device 100 may comprise the above-mentioned display panel 101 and an input device 102. The input device 102 transmits the image signals to the display panel 101 and controls the display panel 101 to display images. According to an embodiment of the invention, the electronic device 100 may be implemented as various devices, comprising: a mobile phone, a digital camera, a personal digital assistant (PDA), a lap-top computer, a personal computer, a television, an in-vehicle display, a portable DVD player, or any apparatus with image display functionality.

Figure 2:
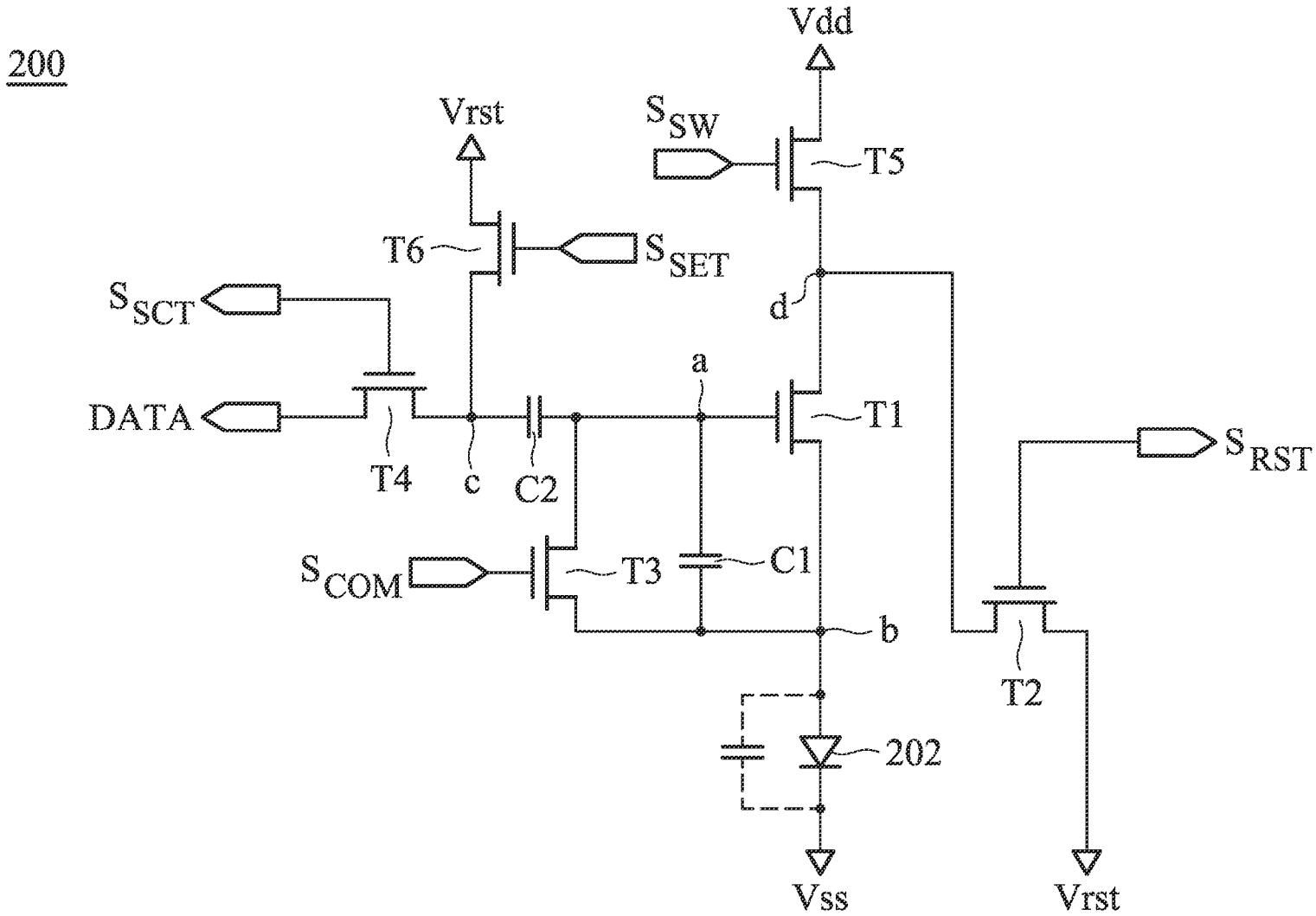
FIG. 2 shows a pixel circuit of a pixel element according to a first embodiment of the invention.

FIG. 2 shows a pixel circuit of a pixel element according to a first embodiment of the invention. The pixel circuit 200 may comprise an Organic Light Emitting Diode (OLED) 202, a plurality of transistors T1~T6 and a plurality of capacitors C1 and C2. As shown in FIG. 2, a first terminal of the transistor T1 is coupled to an anode of the OLED 202 for driving the OLED 202. A cathode of the OLED 202 is coupled to a low operating voltage Vss and the intrinsic capacitor of OLED 202 is also shown in FIG. 2 by dotted lines. The transistor T2 is coupled between a second terminal of the transistor T1 and a reset voltage Vrst, and comprises a control terminal receiving a reset signal $S_{RST}$. The transistor T3 is coupled between the anode of the OLED 202 and a control terminal of the transistor T1 and comprises a control terminal receiving a compensation signal $S_{COM}$. The transistor T4 is coupled between the capacitor C2 and a data line DATA and comprises a control terminal receiving a scan signal $S_{SCT}$. The transistor T5 is coupled between the transistor T1 and a high operating voltage Vdd and comprises a control terminal for receiving a switch signal $S_{SW}$. The transistor T6 is coupled to transistor T4, the capacitor C2 and the reset voltage Vrst and comprises a control terminal for receiving a set signal $S_{SET}$.

Note that according to the embodiments of the invention, the capacitor C1 is coupled between the control terminal of the transistor T1 and the anode of the OLED 202, and the capacitor C2 is coupled to the control terminal of the transistor T1, the capacitor C1 and the transistor T4. For illustrating the operations of the pixel circuit in different operating phases, four nodes 'a', 'b', 'c', and 'd' are defined in the pixel circuit. The capacitors C1 and C2 and the transistor T1 are coupled at node 'a', the transistor T1 and the OLED 202 are coupled at node 'b', the capacitor C2 and the transistor T4 are coupled at node 'c' and the transistors T1 and T2 are coupled at node 'd'.

Figure 3:
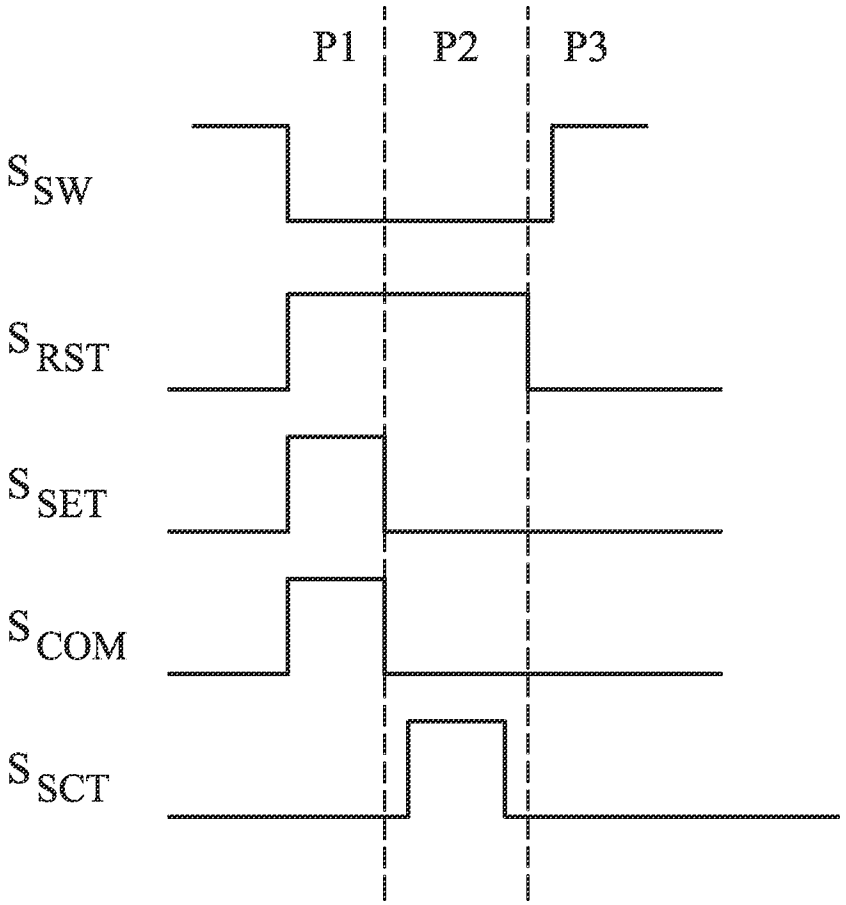
FIG. 3 shows waveforms of the control signals according to the first embodiment of the invention.

FIG. 3 shows waveforms of the control signals according to the first embodiment of the invention. Accompanying FIG. 2 with FIG. 3, the operations of the pixel circuit in different operating phases are illustrated in the following paragraphs. In the embodiment of the invention, operations of the pixel circuit may be divided into three operating phases, including a first operating phase P1, which is a reset and compensating phase, a second operating phase P2, which is a data writing phase and a third operating phase P3, which is an emitting phase. As shown in FIG. 3, during the first operating phase P1, the reset signal $S_{RST}$, the set signal $S_{SET}$, and the compensation signal $S_{COM}$ are set to high voltage levels. The transistor T2 is turned on in response to the reset signal $S_{RST}$, such that a voltage at the node 'd' is set to the reset voltage Vrst. The transistor T6 is turned on in response to the set signal $S_{SET}$, so that the voltage at the node 'c' is set to the reset voltage Vrst. The transistor T3 is turned on in response to the compensation signal $S_{COM}$ so as to make the transistor T1 become a diode-connected transistor. Meanwhile, the transistor T1 is turned on and discharged through the node 'd', until the transistor T1 is turned off when the voltage at node 'a' reaches the reset voltage Vrst plus a threshold voltage Vt of the transistor T1. At this time, since the transistor T3 is turned on, the voltage at the node 'b' equals to that at the node 'a'.

Figure 4B:
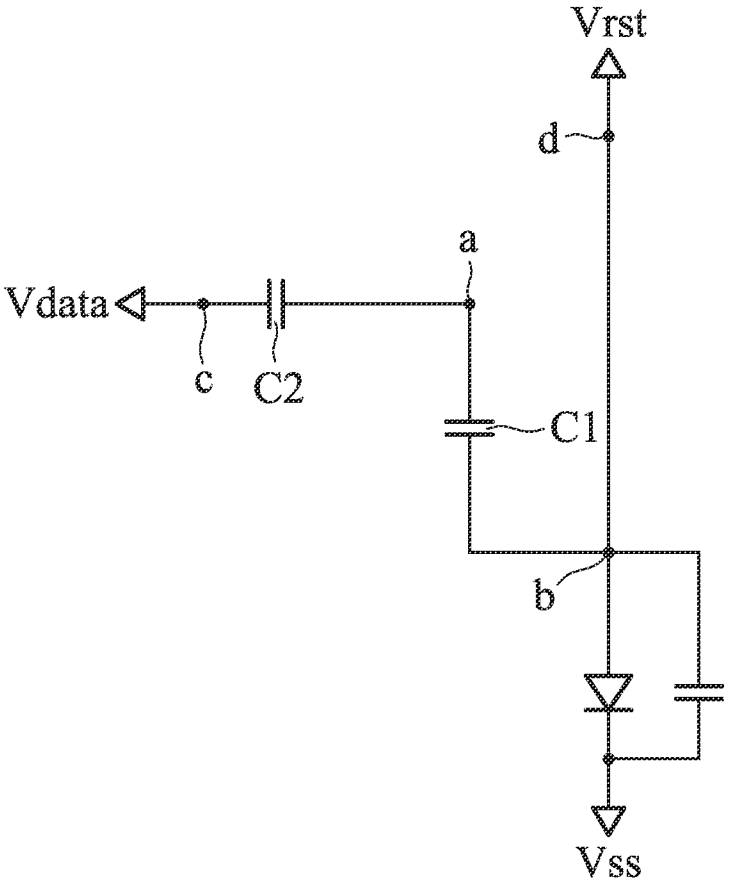
FIG. 4B shows an equivalent circuit of the pixel circuit during the second operating phase P2 according to an embodiment of the invention.
Figure 4A:
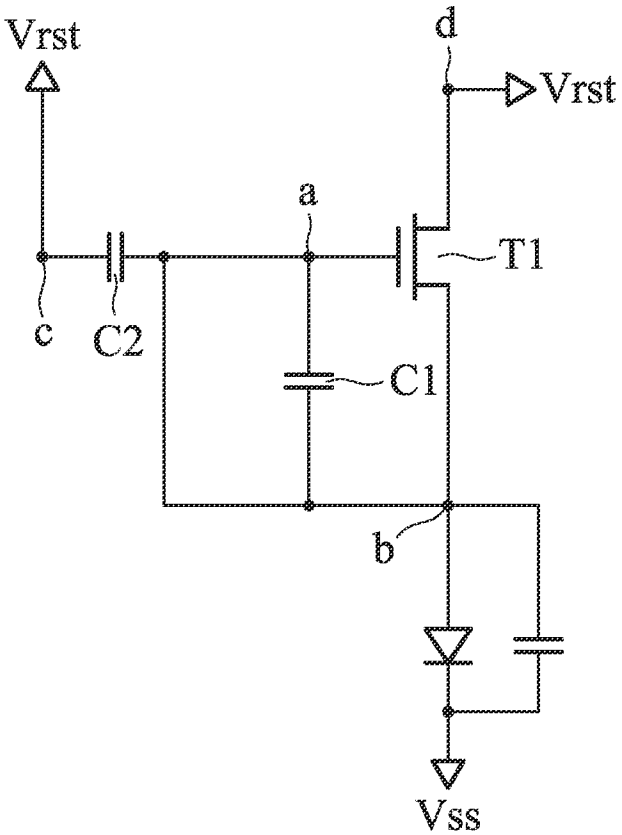
FIG. 4A shows an equivalent circuit of the pixel circuit during the first operating phase P1 according to an embodiment of the invention.

FIG. 4A shows an equivalent circuit of the pixel circuit during the first operating phase P1 according to an embodiment of the invention. As discussed above, during the first operating phase P1, the voltages at nodes 'c' and 'd' are set to the reset voltage Vrst, and the voltages at the nodes 'a' and 'b' are set to the reset voltage Vrst plus a threshold voltage Vt of the transistor T1. Because the reset voltage Vrst is lower than the low operating voltage Vss, the OLED 202 is in a reverse state and will not emit light.

During the second operating phase P2, the reset signal $S_{RST}$ and the scan signal $S_{SCT}$ are set to high voltage levels. The transistor T2 is turned on in response to the reset signal $S_{RST}$ so that the voltage at the node 'd' is set to the reset voltage Vrst. The transistor T4 is turned on in response to the scan signal $S_{SCT}$ while the data voltage Vdata is passed to the pixel circuit via the data driving signal transmitted on the data line, so that the voltage at node 'c' is set to the data voltage Vdata. Since the voltage at the node 'c' is raised from the reset Vrst in the first operating phase P1 to the data voltage Vdata, the voltage change is coupled to the node 'a' via the capacitor C2 so that the voltage at the node 'a' is set to Vrst+Vt+(Vdata−Vrst)*a, where a=C2/(C1+C2). At this time, the transistor T1 is turned on again in response to the voltages at the node 'a' and the node 'd' so that the voltage at the node 'b' equals to the voltage at the node 'd' and is set to the reset voltage Vrst.

FIG. 4B shows an equivalent circuit of the pixel circuit during the second operating phase P2 according to an embodiment of the invention. As discussed above, during the second operating phase P2, the voltages at the node 'd' and node 'b' are set to the reset voltage Vrst and the voltage at the node 'c' is set to the data voltage Vdata due to the input data, and the voltage at the node 'a' is set to Vrst+Vt+(Vdata−Vrst)*a, where a=C2/(C1+C2), as well as the one used in Eq. (1) shown below. Because the reset voltage Vrst is lower than the low operating voltage Vss, the OLED 202 is in a reverse state and will not emit light.

During a third operating phase P3, the switch signal $S_{SW}$ is set to a high voltage level. The transistor T5 is turned on in response to the switch signal $S_{SW}$, such that a voltage at the node 'd' is set to a voltage level which is close to the high operating voltage Vdd. Meanwhile, the transistor T1 is turned on in response to the voltage difference between the voltages at the node 'b' and node 'a', thus, the OLED 202 emits light. Thereafter, the voltage at the node 'b' is set to the driving voltage Voled of the OLED 202. Since the voltage at the node 'b' is raised to from the reset Vrst in the second operating phase P2 to the driving voltage Voled, the voltage change is coupled to the node 'a' via the capacitor C1 so that the voltage at the node 'a' is set to Vt+(Vdata−Vrst)*a+Voled. Similarly, since the node 'c' is now floating, the voltage change at the node 'a' is coupled to the node 'c' via the capacitor C2. Therefore, the voltage at the node 'c' is set to the data voltage Vdata plus the driving voltage Voled of the OLED 202, minus the reset voltage Vrst.

Figure 4C:
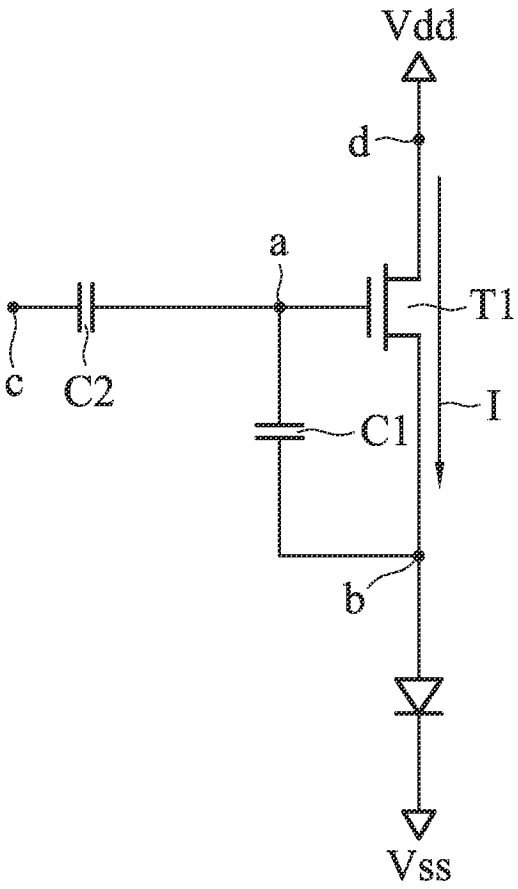
FIG. 4C shows an equivalent circuit of the pixel circuit during the third operating phase P3 according to an embodiment of the invention.

FIG. 4C shows an equivalent circuit of the pixel circuit during the third operating phase P3 according to an embodiment of the invention. As discussed above, during the third operating phase P3, the OLED 202 is in the emitting state and emits light. At this time, the current I flowing through the transistor T1 can be derived as below:

$$\begin{aligned} I &= K \times (Vgs - Vt)^2 \qquad \text{Eq. (1)} \\ &= K \times (Va - Vb - Vt)^2 \\ &= K \times (Vt + (Vdata - Vrst) * a + Voled - Voled - Vt)^2 \\ &= K \times ((Vdata - Vrst) * a)^2 \end{aligned}$$

where $$K = \frac{1}{2}\mu \cdot C_{ox} \cdot \frac{W}{L},$$

μ is the electron mobility, $C_{OX}$ is the capacitance of the insulation layer, $$\frac{W}{L}$$

is the ratio of the width W to the length L of the transistor. From Eq. (1), when the OLED emits light, the current flowing through the transistor T1 is independent from the voltage changes in the threshold voltage Vt of the transistor T1 and the OLED. In other words, the current generated when the OLED emits light will not be affected by the threshold voltage drift of the transistor T1 and the voltage change at the OLED, thus, threshold voltage drift and the voltage change at the OLED is successfully compensated for in the current.

Table 1 summarizes the voltage level at different nodes during different phases.

| | P1 | P2 | P3 |
|---|---|---|---|
| a | Vrst + Vt | Vrst + Vt + (Vdata − Vrst)* a | Vt + (Vdata − Vrst)* a + Voled |
| b | Vrst + Vt | Vrst | Voled |
| c | Vrst | Vdata | Vdata + Voled − Vrst |
| d | Vrst | Vrst | ~Vdd |

where a = C2/(C1 + C2)

Note that in the embodiments of the invention, the control signals may be simplified according to different design requirements. For example, the set signal $S_{SET}$ and the compensation signal $S_{COM}$ may be simplified to be provided by the same signal line.

Figure 5:
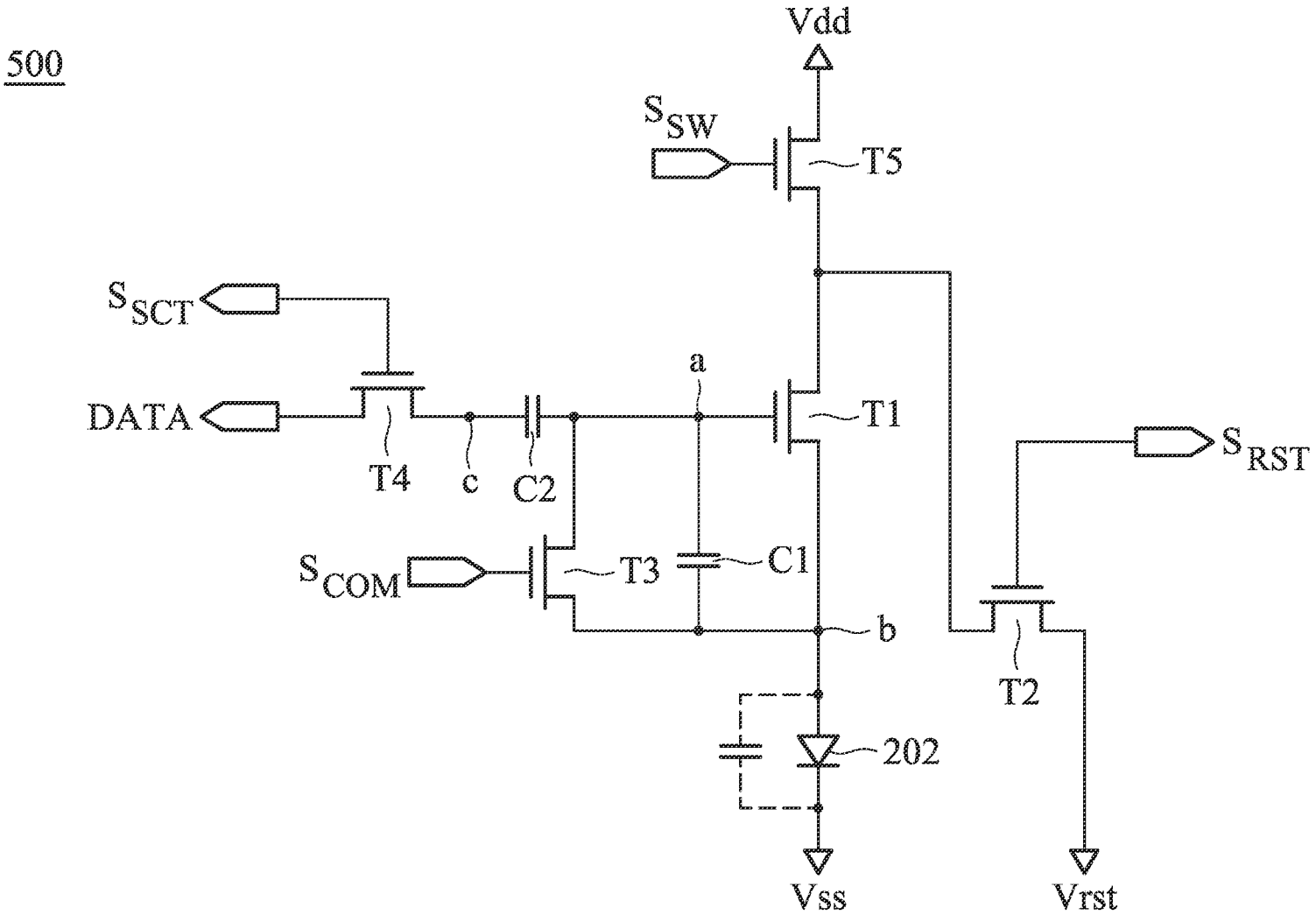
FIG. 5 shows another pixel circuit of a pixel element according to a second embodiment of the invention.
Figure 6:
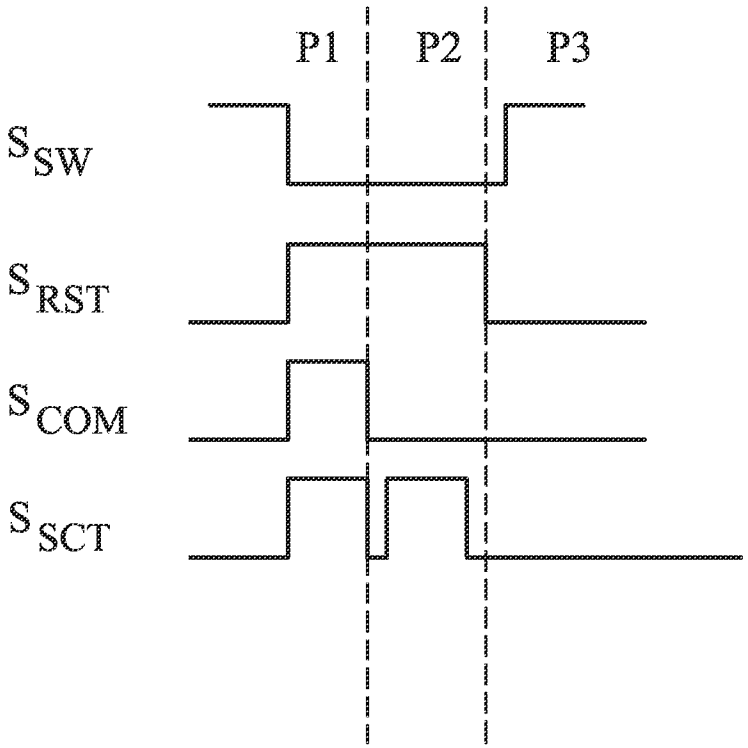
FIG. 6 shows waveforms of the control signals according to the second embodiment of the invention.

FIG. 5 shows another pixel circuit of a pixel element according to a second embodiment of the invention. The pixel circuit 500 may comprise an OLED 202, a plurality of transistors T1~T5 and a plurality of capacitors C1 and C2. In the second embodiment of the invention, the circuit structure is the same as the pixel circuit 200 as shown in FIG. 2, except for the transistor T6 and the set signal $S_{SET}$ being removed. Therefore, reference may be made to the descriptions of FIG. 2 for the description of the pixel circuit 500, and is omitted here for brevity. FIG. 6 shows waveforms of the control signals according to the second embodiment of the invention. In the second embodiment, since the transistor T6 and the set signal $S_{SET}$ are removed, the timing controller may control the voltage of the scan signal $S_{SCT}$ at a high voltage level during the first operating phase P1 and at the same time transmit the reset voltage Vrst to the corresponding data line DATA.

In the second embodiment of the invention, during the first operating phase P1, the transistor T4 is turned on in response to the scan signal $S_{SCT}$ and therefore, sets the voltage at node 'c' to the reset voltage Vrst. In other words, since the transistor T4 is turned on, the voltage at the node 'c' is set to the reset voltage Vrst. In this manner, even if the transistor T6 and the set signal $S_{SET}$ are removed, the voltage at the node 'c' can still be set to the reset voltage Vrst during the first operating phase via the scan signal $S_{SCT}$ and the transistor T4. As the remaining operations of the remaining transistors and the remaining voltages at the remaining nodes of the pixel circuit 500 during the first operating phase P1 and the operations of the pixel circuit 500 during the second operating phase P2 and the third operating phase P3 are the same as that of the pixel circuit 200, reference may be made to the descriptions of FIG. 2-FIG. 4 and Table 1, and are omitted here for brevity.

Note that in the second embodiment of the invention, since the amount of transistors in the pixel circuit is fewer than that in the first embodiment, the circuit layout area is effectively reduced. Therefore, the aperture ratio of the display panel can be increased. In addition, note that in the embodiments of the invention, it is preferable to adopt N-type transistors for the transistors T1~T6 (or T1~T5), and adopt a normal OLED for the OLED 202. As discussed above, the process of normal OLEDs is simpler than reversed OLEDs. In addition, note that there is no need to align the rising edge/falling edge of the control signals with the switching points of the operating phases as shown in FIG. 3 and FIG. 6. The waveforms of the control signals may be flexibly designed as long as the same or similar operation results may be achieved.

A first feature of the proposed pixel circuit is that a diode-connected transistor may be formed between the node 'a' and the node 'b' via the transistor T3. Therefore, during the first operating phase P1, the transistor T1 is turned on to form a discharge path and discharges through the node 'd'. The voltage at the node 'a' is finally set to the reset voltage Vrst plus the threshold voltage Vt of the transistor T1. In this manner, the threshold voltage Vt can be completely compensated for at the node 'a', and as shown in Eq. (1), this term can finally be eliminated from the output current of the transistor T1 so that the output current of the transistor T1 becomes independent from the threshold voltage Vt. In other words, it does not matter whether the threshold voltage Vt drifts due to the initial difference between the different the transistors or long operation time of the transistors, the drift in the threshold voltage Vt will not affect the output current of the transistor T1. Therefore, undesirable dark or bright lines (call MURA effect) will not be generated like the conventional designs and the inaccurate threshold voltage compensation problem may be resolved.

In addition, a second feature of the proposed pixel circuit is that during the third operating phase P3, the voltage change at the node 'b' is coupled to node 'a' via the capacitor C1, so that the driving voltage Voled of the OLED can be completely compensated for at the node 'a'. In this manner, as shown in Eq. (1), this term can finally be eliminated from the output current of the transistor T1, so that the output current of the transistor T1 becomes independent from the driving voltage Voled of the OLED. In other words, even if the driving voltage Voled of the OLED increases as the operation time increases, the output current of the transistor T1 will not be affected. Therefore, the inaccurate driving voltage Voled compensation problem as with conventional designs is resolved.

Besides the two advantages as illustrated above, the control signals are simple for the proposed pixel circuit and there is no need to change the level of the operating voltage (such as Vss). Therefore, the design of display panel can be very simple and the system power can be greatly saved.

While the invention has been described by way of example and in terms of preferred embodiment, it is to be understood that the invention is not limited thereto. Those who are skilled in this technology can still make various alterations and modifications without departing from the scope and spirit of this invention. Therefore, the scope of the present invention shall be defined and protected by the following claims and their equivalents.

What is claimed is:

1. A display device, comprising:

a pixel array, comprising a plurality of pixel elements, wherein at least one of the pixel elements comprises:

an OLED;

a first transistor, comprising a first terminal coupled to an anode of the OLED for driving the OLED;

a second transistor, coupled between a second terminal of the first transistor and a reset voltage and comprising a control terminal receiving a reset signal;

a third transistor, coupled between the anode of the OLED and a control terminal of the first transistor and comprising a control terminal receiving a compensation signal;

a first capacitor, coupled between the control terminal of the first transistor and the anode of the OLED;

a second capacitor, coupled to the first capacitor and the control terminal of the first transistor, a fourth transistor, coupled between the second capacitor and a data line and comprising a control terminal receiving a scan signal, and a fifth transistor, coupled between the first transistor and an operating voltage and comprising a control terminal for receiving a switch signal, wherein the first capacitor, the second capacitor and the first transistor are coupled at a first node, the first transistor and the OLED are coupled at a second node, the second capacitor and the fourth transistor are coupled at a third node and the first transistor and the second transistor are coupled at a fourth node, wherein during a third operating phase, the fifth transistor is turned on, such that a voltage at the fourth node is set to a voltage level which is close to the operating voltage, the first transistor is turned on and the OLED emits light, such that a voltage at the second node is set to a driving voltage of the OLED, and a voltage at the first node is set to the data voltage plus a threshold voltage of a transistor further plus the voltage at the second node and minus the reset voltage via the first capacitor.

2. The display device as claimed in claim 1, further comprising a display panel, wherein the display panel comprises:

the pixel array;

a gate driving circuit, outputting a plurality of gate driving signals for driving the pixel array;

a data driving circuit, outputting a plurality of data driving signals for providing data to the pixel array; and a controller chip, for controlling operations of the display panel.

3. The display device as claimed in claim 1, wherein the at least one of the pixel elements further comprises:

a sixth transistor, coupled between the third node and the reset voltage and comprising a control terminal for receiving a set signal.

4. The display device as claimed in claim 3, wherein during a first operating phase, the second transistor and the sixth transistor are turned on, such that a voltage at the fourth node and a voltage at the third node are set to the reset voltage, and the third transistor is turned on, such that a voltage at the first node and a voltage at the second node are set to the reset voltage plus a threshold voltage of a transistor.

5. The display device as claimed in claim 1, wherein during a first operating phase, a voltage at the third node is set to the reset voltage, the second transistor is turned on, such that a voltage at the fourth node is set to the reset voltage, and the third transistor is turned on in response to the compensation signal, such that a voltage at the first node and a voltage at the second node are set to the reset voltage plus a threshold voltage of a transistor.

6. The display device as claimed in claim 5, wherein the fourth transistor is turned on so that the voltage at the third node is set to the reset voltage.

7. The display device as claimed in claim 1, wherein during a second operating phase, the second transistor and the fourth transistor are turned on, such that a voltage at the fourth node and a voltage at the third node are reset to the reset voltage and a data voltage, respectively, and a voltage at the first node is set to the data voltage plus a threshold voltage of a transistor via the second capacitor, and the first transistor is turned on in response to the voltages at the first node and the fourth node, such that a voltage at the second node is set to the reset voltage.

8. The display device as claimed in claim 1, wherein during a first operating phase, the third transistor is turned on in response to the compensating signal so that the first transistor becomes a diode-connected transistor.

* * * * *